US006147661A

United States Patent [19]

Nakagawa et al.

[11] Patent Number: 6,147,661

[45] Date of Patent: Nov. 14, 2000

[54] HELICAL COIL, METHOD OF PRODUCING SAME AND HELICAL ANTENNA USING SAME

[75] Inventors: Yoshinobu Nakagawa, Senboku-gun; Susumu Inatsugu, Hirakata; Masaaki Yamabayashi, Tsuyama; Kazuji Ota, Hirakata; Yoshiharu Abe, Katano; Koji Sako, Katsuta-gun; Naoyuki Yayama, Tsuyama, all of Japan

[73] Assignee: Matsushita Electric Industrial Co., Ltd., Japan

[21] Appl. No.: 09/120,877

[22] Filed: Jul. 23, 1998

[30] Foreign Application Priority Data

Jul. 23, 1997 [JP] Japan ..... 9-196702

[51] Int. Cl.[7] ..... H01Q 1/24; H01Q 1/36

[52] U.S. Cl. ..... 343/895; 343/702; 29/600

[58] Field of Search ..... 343/895, 702, 343/873, 872, 787, 788; 29/600; H01Q 1/24, 1/36

[56] References Cited

U.S. PATENT DOCUMENTS

| | | | |
|---|---|---|---|
| 4,435,713 | 3/1984 | Gasparaitis et al. | 343/702 |
| 4,725,395 | 2/1988 | Gasparaitis et al. | 264/250 |
| 4,862,184 | 8/1989 | Ploussios | 343/745 |
| 5,341,149 | 8/1994 | Valimaa et al. | 343/895 |
| 5,479,178 | 12/1995 | Ha | 343/702 |
| 5,596,797 | 1/1997 | Bumsted | 29/601 |
| 5,648,788 | 7/1997 | Bumsted | 343/895 |
| 5,764,198 | 6/1998 | Tsuru et al. | 343/895 |
| 5,818,398 | 10/1998 | Tsuru et al. | 343/895 |
| 5,892,490 | 4/1999 | Asakura et al. | 343/895 |

FOREIGN PATENT DOCUMENTS

| | | |
|---|---|---|
| 2 282 705 | 4/1995 | United Kingdom . |
| WO 93/00721 | 1/1993 | WIPO . |
| WO 97/07560 | 2/1997 | WIPO . |

OTHER PUBLICATIONS

Patent Abstract of Japan; vol. 7, No. 251 (E–209); Nov. 8, 1983 & JP 58 137206 A (Sony); Aug. 15, 1983 *abstract*.

Patent Abstracts of Japan; vol. 18, No. 188 (E–1532); Mar. 31, 1994 & JP 05 347507 A (Junkosha); Dec. 27, 1993 *abstract*.

*Primary Examiner*—Hoanganh Le
*Attorney, Agent, or Firm*—Parkhurst & Wendell, L.L.P.

[57] ABSTRACT

A helical coil and a top-helical type antenna using the same, wherein the helical coil has a plurality of either substantially U-shaped or nearly V-shaped branch portions made of a thin metallic sheet material. The branch portions are connected continuously in a manner to place their open ends alternately inversely, and the branch portions alternatively curve toward an obverse side and a reverse side of the metallic sheet to form each turn of the coil. A method for producing the helical coil includes continuously die cutting a member on a belt-shaped strip of electrically conductive metallic sheet, and alternately placing a plurality of either substantially U-shaped or substantially V-shaped branch portions with their open ends inversely. These substantially U or V-shaped branch portions are then connected with each other in the shape of a letter, with connection to the metallic sheet being held only by linkage portions at opposite sides. The helical coil is formed by alternately curving the branch portions of each of the members in a shape of substantially circular arc toward an obverse side and a reverse side of the metallic sheet. A bobbin is formed connecting each turn of the helical coil by either insert-injection molding or outsert-injection molding of electrically nonconductive material on the individual helical coil formed on metallic sheet and subsequently the linkage portions are sheared off of the metallic sheet.

21 Claims, 12 Drawing Sheets

HELICAL COIL, METHOD OF PRODUCING SAME AND HELICAL ANTENNA USING SAME

FIELD OF THE INVENTION

The present invention relates to a helical coil, a method of producing the same, and a top-helical type antenna containing a helical coil for use primarily in wireless transmission equipment for mobile communication such as portable telephones and transmitters.

BACKGROUND OF THE INVENTION

Recently, the popularity of mobile communication devices which utilize wireless transmission equipment, such as portable telephones, has become widespread. The wireless transmission equipment for such mobile communication devices is provided with antennas of various types for transmitting and receiving radio waves. Some commonly-used types of antennas include a top-helical type antenna consisting of a combination of a helical antenna and a whip antenna. The helical antenna functions when the whip antenna is retracted within an enclosure of the transmission equipment, and the whip antenna functions when the helical antenna is in an extended position, allowing ease of portability.

A top-helical type antenna of the prior art is illustrated in FIGS. 1 and 2.

FIG. 1 depicts a cross-sectional view of a prior art top-helical type antenna, wherein a helical antenna element 1 of an electrically conductive metal wire such as copper and a copper alloy is wound in coil form, a bobbin 2 is made of insulating polymeric resin and a feeding fixture 3 is made of electrically conductive metal. The helical antenna element 1 is wound on the bobbin 2 and is electrically connected at its lower end to the feeding fixture 3. A cover 4 of insulating resin encloses helical antenna 5.

Further, a conductor 1 made of electrically conductive metal is disposed within a resin-insulated tube 7 that forms a sleeve on an outer surface of the conductor 6. Conductor 6 is also electrically connected at a lower end to stopper 8, also made of electrically conductive metal, to comprise a whip antenna 9. Helical antenna 5 is joined at its lower end to the upper end of whip antenna 9 by insulator 10.

An antenna holder 11 made of electrically conductive material is provided with a through hole 11A at its center, and an outer periphery having threads 11B. The whip antenna 9 is inserted into the through hole 11A, and an outer surface of the stopper 8 contacts with an inner surface of the through hole 11A via a spring 12 fitted within the through hole 11A. This top-helical type antenna 14 is mounted to an enclosure 16 of wireless transmission equipment 15 by feeding nut 13 screwed into the threads 11B of the antenna holder 11.

Radio waves are transmitted and received by the whip antenna 9 that is electrically connected through contact stopper 8 with the antenna holder 11 fitted to the wireless transmission equipment 15, as the top-helical type antenna 14 is extended. When the whip antenna 9 is stored within the enclosure 16 of the wireless transmission equipment 15 by being pushed inside of the equipment 15, as shown in FIG. 2, the stopper 8 of the antenna 9 separates from the antenna holder 11, and the feeding fixture 3 of the helical antenna 5 makes contact with the antenna holder 11 for electrical connection, so that the radio waves are transmitted and received by the helical antenna 5.

However, prior art top-helical type antennas have a problem in that the impedance characteristic properly corresponding to the objective frequency band of radio waves is not easily obtainable due to winding diameters and winding pitches that are subject to dimensional dispersion during winding on the bobbin 2. This problem occurs because the helical antenna element 1 of the helical antenna 5 comprises a conductive metal wire wound in a coil form.

SUMMARY OF THE INVENTION

An object of the present invention is to resolve the above-mentioned problem of prior art top-helical type antenna, and to provide a helical antenna having helical coil elements that are not likely to deform, easy to assemble and are less expensive than previous top-helical type antennas.

A helical coil of the present invention comprises one of a plurality of substantially U-shaped or substantially V-shaped branch portions made of a thin metallic sheet material with the branch portions continuously connected such that their open ends inversely alternate. Each turn of the coil is formed by alternately curving the branch portions toward an obverse side and then a reverse side of the metallic sheet.

A method of producing the helical coil comprises continuously die-cutting coil members on a belt-shaped strip of an electrically conductive metallic sheet wherein the coil member comprises one of a plurality of either substantially U-shaped or substantially V-shaped branch portions;

placing the open ends of the branch portions alternately inversely; and connecting these substantially U-shaped or substantially V-shaped branch portions with each other in the shape of the letter W by shifting one by one, with connection to the electrically conductive metallic sheet being held only by linkage portions at both sides; forming the helical coil by alternatively curving the branch portions of each of the coil members toward an obverse side and then a reverse side of the metallic sheet in a shape of nearly circular arc;

forming a bobbin for connecting each turn of the helical coil by either insert-injection molding or outsert-injection molding of electrically nonconductive material on the individual helical coil formed of the belt-shaped strip of electrically conductive metallic sheet; and shearing off the linkage portions to the electrically conductive metallic sheet.

This invention provides a helical antenna having a coil element that is not likely to deform, is easy to assemble and is less expensive than the helical coil antennas of the prior art.

DESCRIPTION OF THE PREFERRED EMBODIMENTS

First Embodiment

Figure 1:
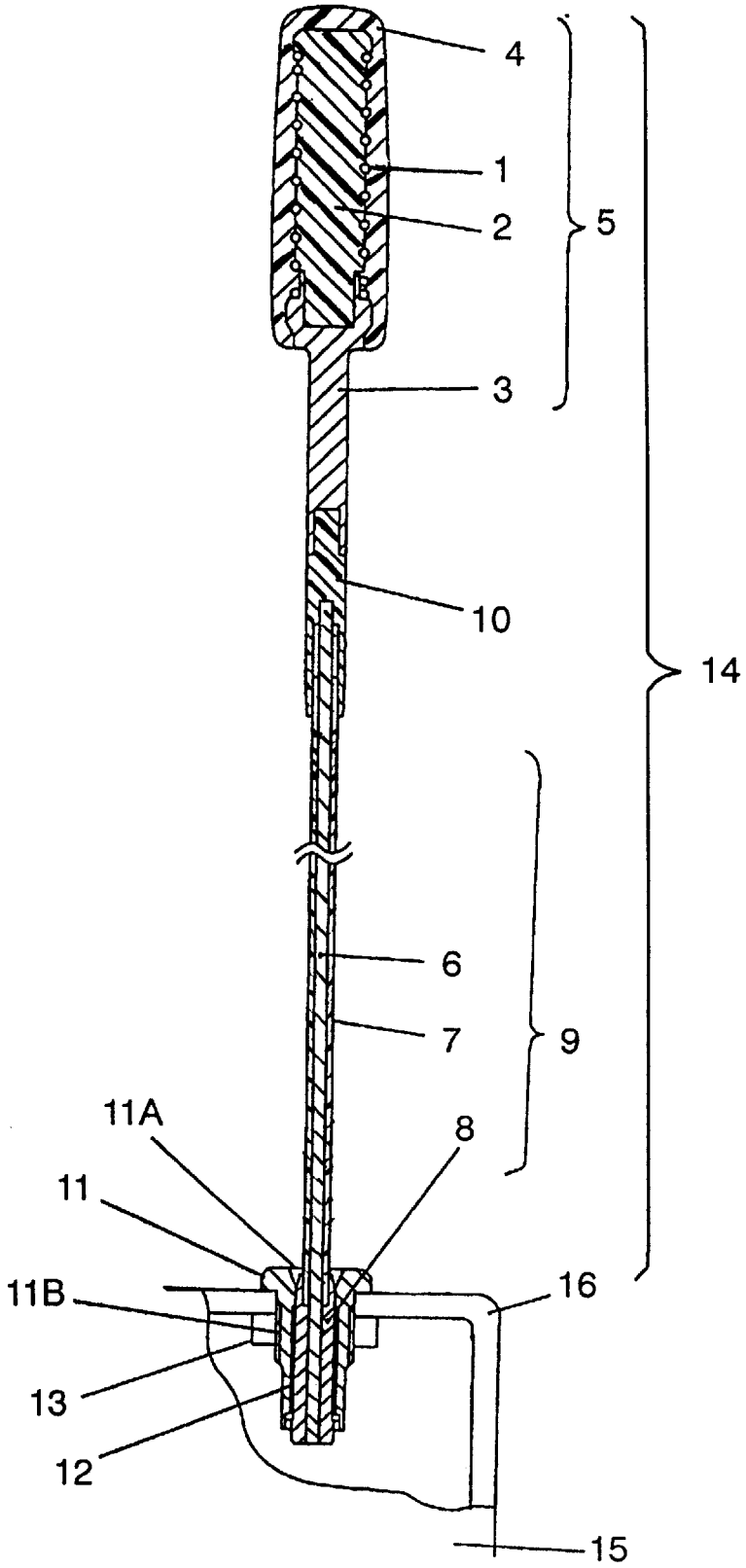
FIG. 1 PRIOR ART
FIG. 1 is a cross-sectional view of a conventional top-helical type antenna.
Figure 2:
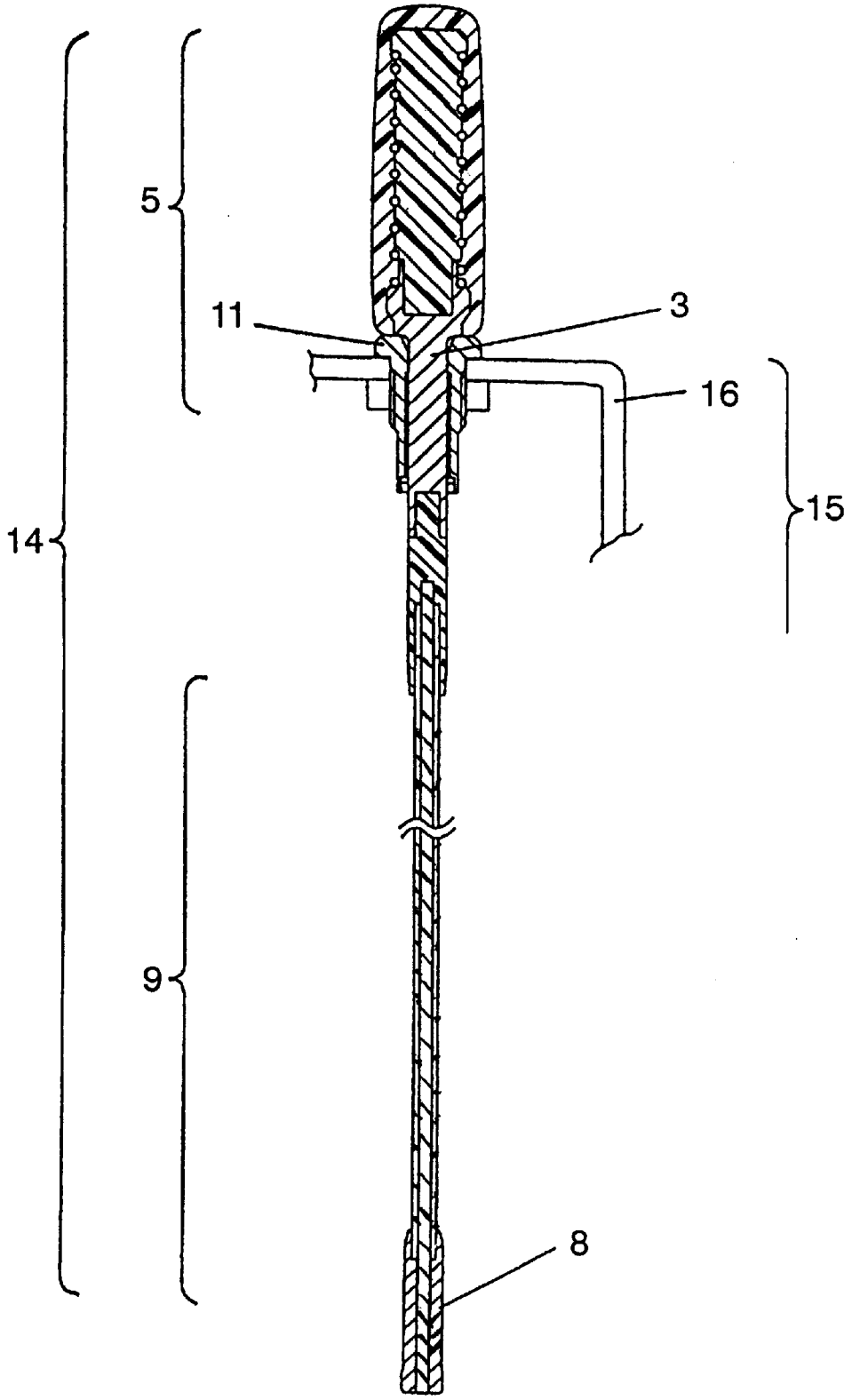
FIG. 2 PRIOR ART
FIG. 2 is a cross-sectional view of the conventional top-helical type antenna stored within an enclosure of wireless transmission equipment.
Figure 3:
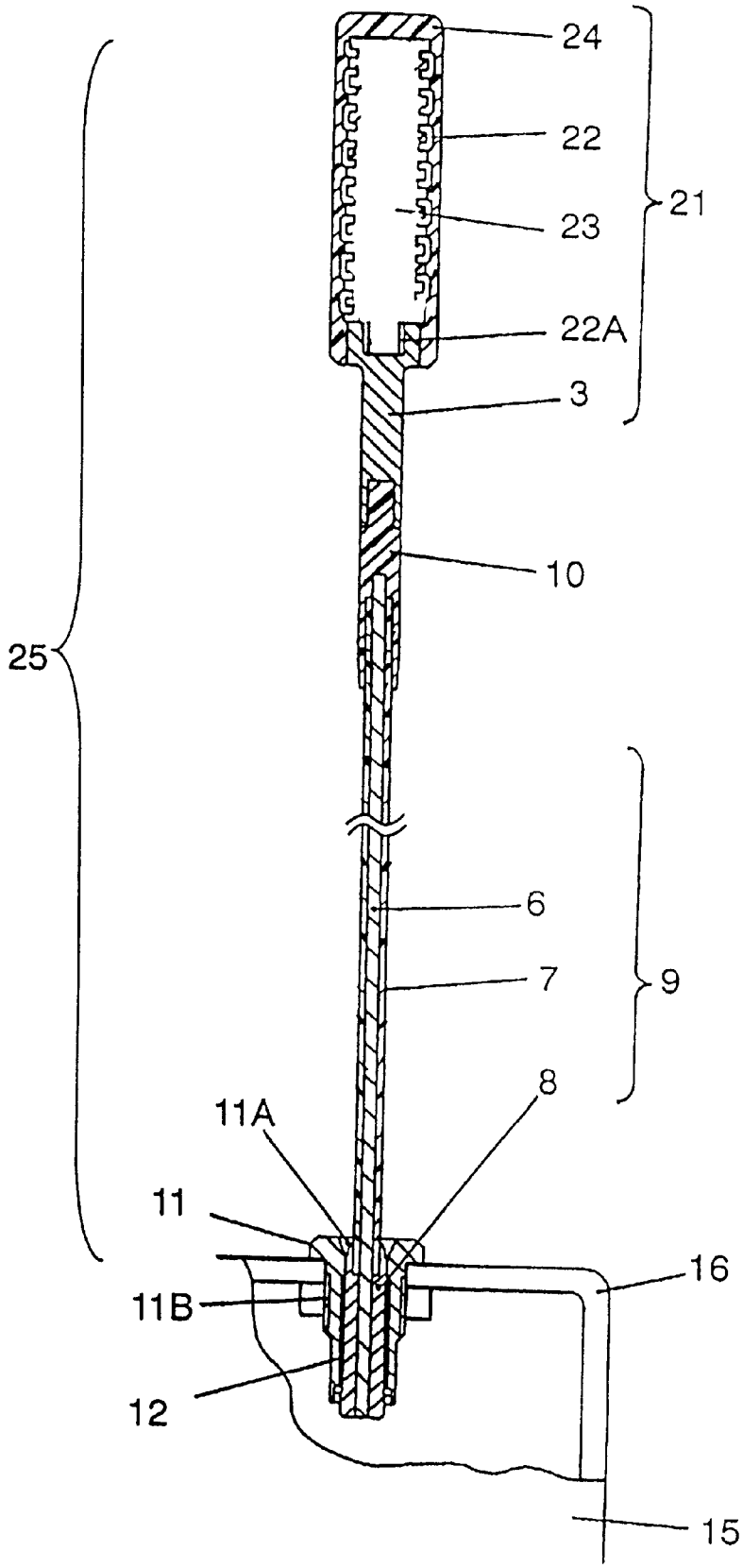
FIG. 3 is a cross-sectional view of a top-helical type antenna of a first embodiment of the present invention.

A helical coil according to a first embodiment of the present invention, a method of producing same, and a top-helical type antenna utilizing the helical coil are described below and illustrated by FIGS. 3 to 7. FIG. 3 depicts a top-helical type antenna 25 of the present invention having a whip antenna 9 comprising a conductor 6 electrically connected to a stopper 8, and a tube 7 covering an outer periphery of the conductor 6. The top end of the whip antenna 9 is joined with a lower end of the helical antenna 21 through an insulator 10. An outer periphery of the stopper 8 of the whip antenna 9 is inserted into through hole 11A of an antenna holder 11 and is in contact with an inner periphery of the through hole 11A. Antenna holder 11 is fitted in an enclosure 16 of a wireless transmission equipment 15 by threads 11B. Although the above described structure is somewhat similar to the prior art antennas, it differs from the prior art in that a helical antenna element 22 of the helical antenna 21 is made of an electrically conductive metallic sheet.

Helical antenna element 22 is in a coil shape formed of an electrically conductive metallic sheet such as copper and copper alloys and is electrically connected at its connecting part 22A to a conductive feeding fixture 3. An inner periphery is outsert-injection molded with an insulating resin to form a bobbin 23, and an outer periphery is enclosed with a cover 24 of insulating resin formed by insert-injection molding.

Figure 4A:
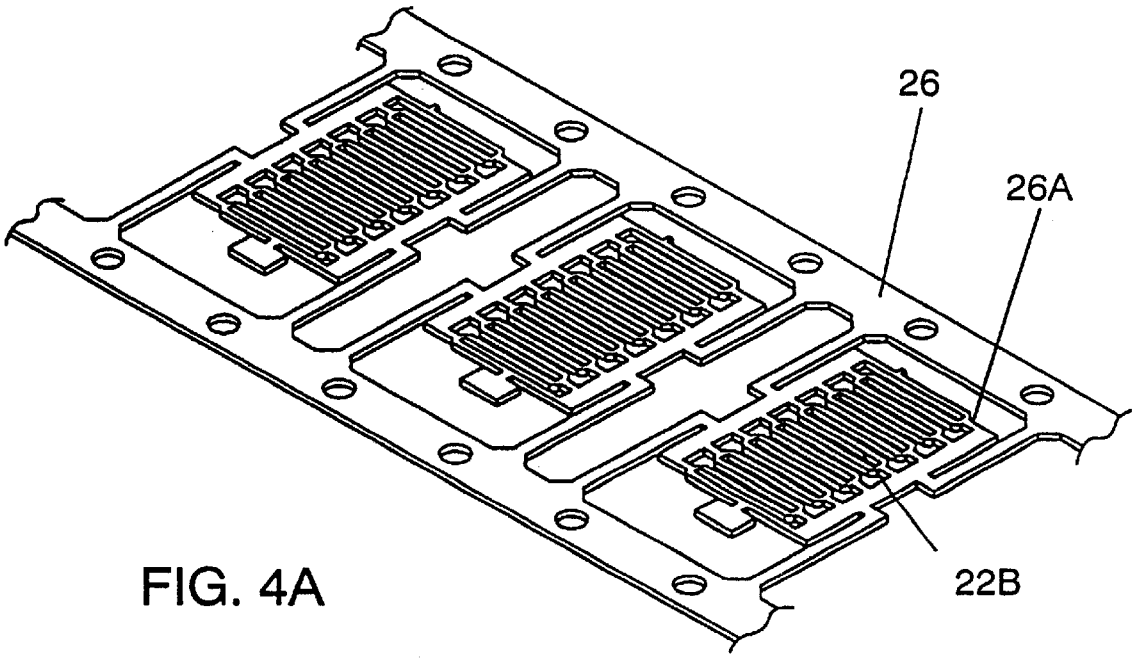
FIG. 4A is a perspective view of a helical coil member of the present invention after the die-cutting process.
Figure 4B:
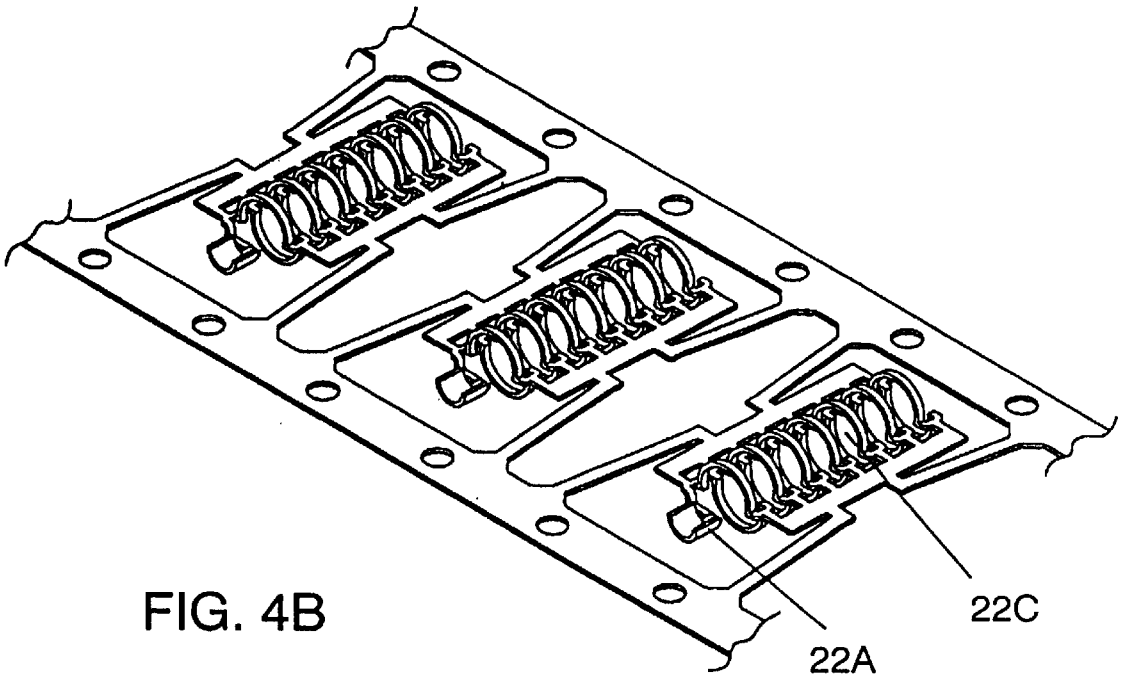
FIG. 4B is a perspective view of the helical coil member of the present invention after the press forming process.
Figure 4C:
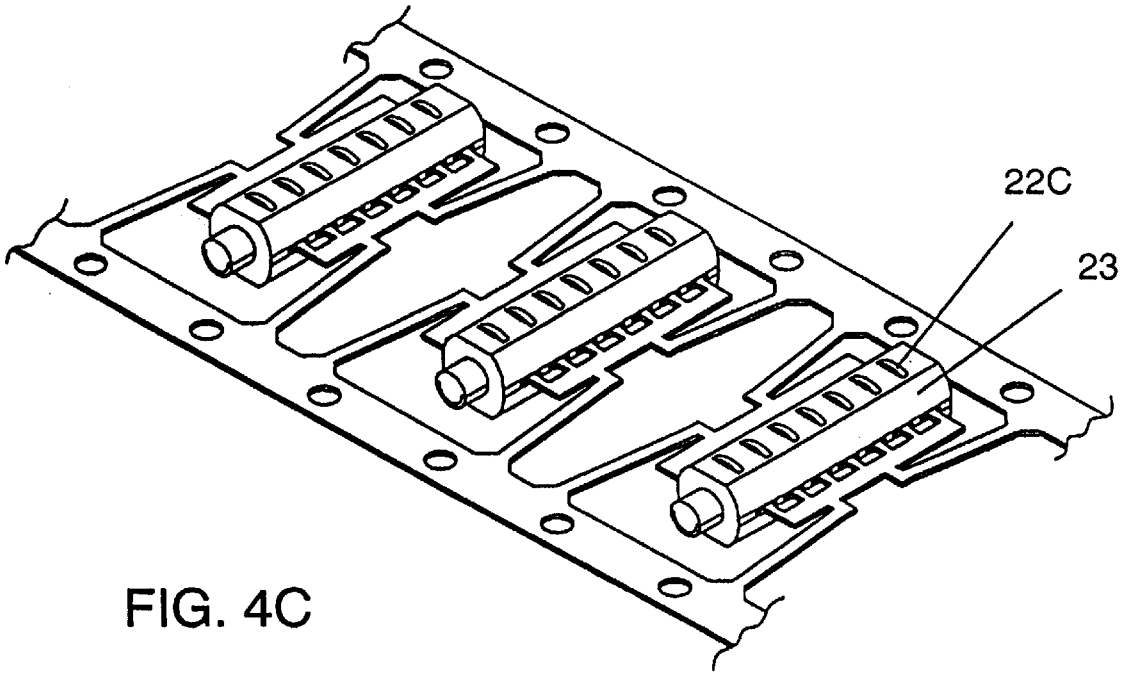
FIG. 4C is a perspective view of the helical coil member of the present invention after outsert-injection molding.

A method of producing the helical coil part of the helical antenna 21 in the top-helical type antenna 25 constituting to this first embodiment is described below. First of all, helical coil members 22B in flat form are die-cut consecutively on a belt-shaped strip of electrically conductive metallic sheet 26, as shown in FIG. 4A. The helical coil member 22B is shaped so that a plurality of substantially U-shaped branch portions and substantially inverse U-shaped branch portions are lined alternately. The substantially U-shaped branch portions and the substantially inverse U-shaped branch portions are connected to form W-shaped letters with connection to the metallic sheet 26 held only by linkage portions 26A at opposing sides. The substantially U-shaped branch portions are connected continuously in a manner to place their open ends alternately inversely. In other words, the helical coil member 22B is S-shaped by uniting the adjoining branch portion of the adjoining U-shaped parts and the branch portions of the inverted U-shaped parts, or having a shape that is configured by a plural number of parts of unitary shape having a linkage portion 26A formed at a bottom of each U-shaped part linked successively in a direction orthogonal to the branch portions of the U-shaped part. A plurality of helical coil members 22C is formed in a coil form along with connecting parts 22A, as shown in FIG. 4B, by press working to curve the branch portions of the substantially U-shaped parts, i.e., center portions between the linkage portions 26A at both sides, in a shape of a substantially circular arc alternatively toward upper and a lower sides, i.e., an obverse side and a reverse side, of the metallic sheet. A bobbin 23 for connecting each turn of the helical coil member 22C is then formed by outsert-injection molding of electrically nonconductive material such as an insulating resin to cover an outer periphery of the helical coil member 22C, including the linkage portions 26A, except for a part of the helical coil member 22C that is exposed as shown in FIG. 4C.

Figure 4D:
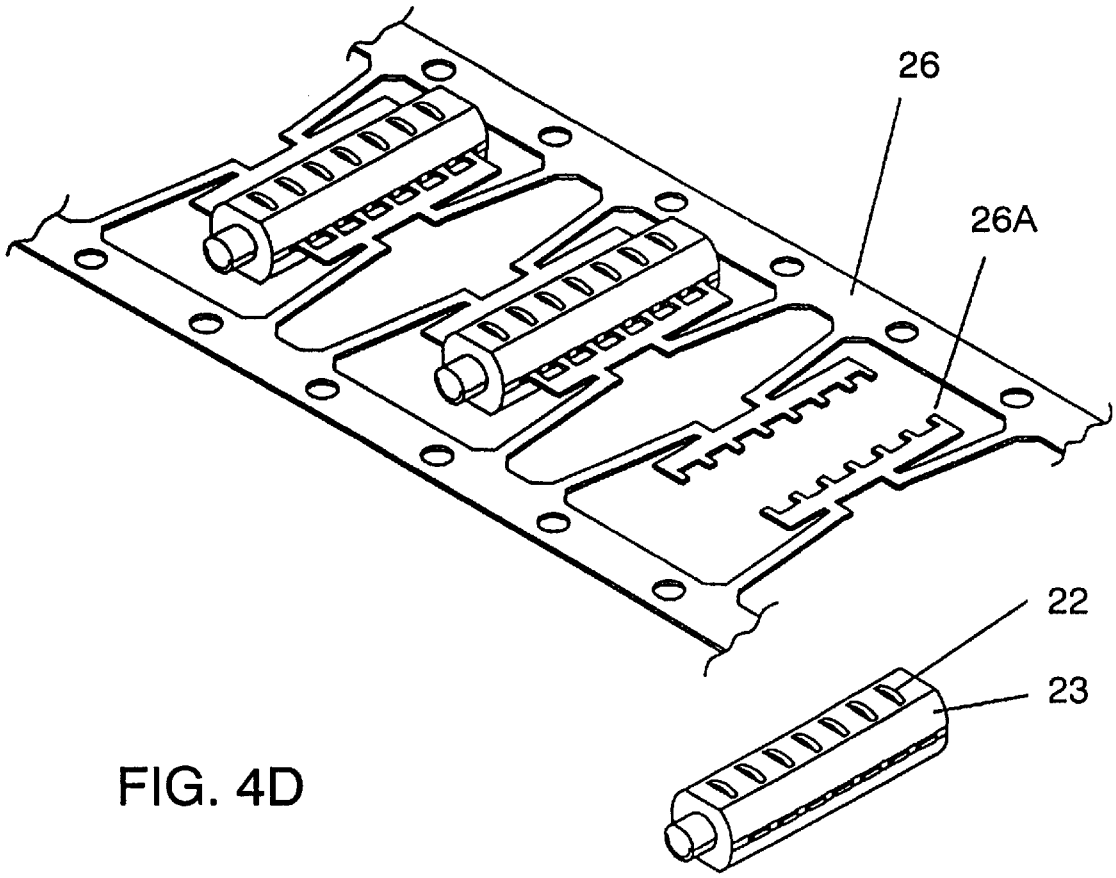
FIG. 4D is a perspective view of the helical coil member of the present invention after shearing off of linkage portions to a electrically conductive metallic sheet.

Finally, as shown in FIG. 4D, the helical antenna element 22 with the bobbin 23 molded into one body is completed by shearing off the linkage portions 26A from the electrically conductive metallic sheet 26. The helical antenna 21 is completed when the cover 24 is formed with an electrically nonconductive material such as an insulating resin to enclose the periphery after the helical antenna element 22 is connected with a conductive feeding fixture 3.

Figure 5:
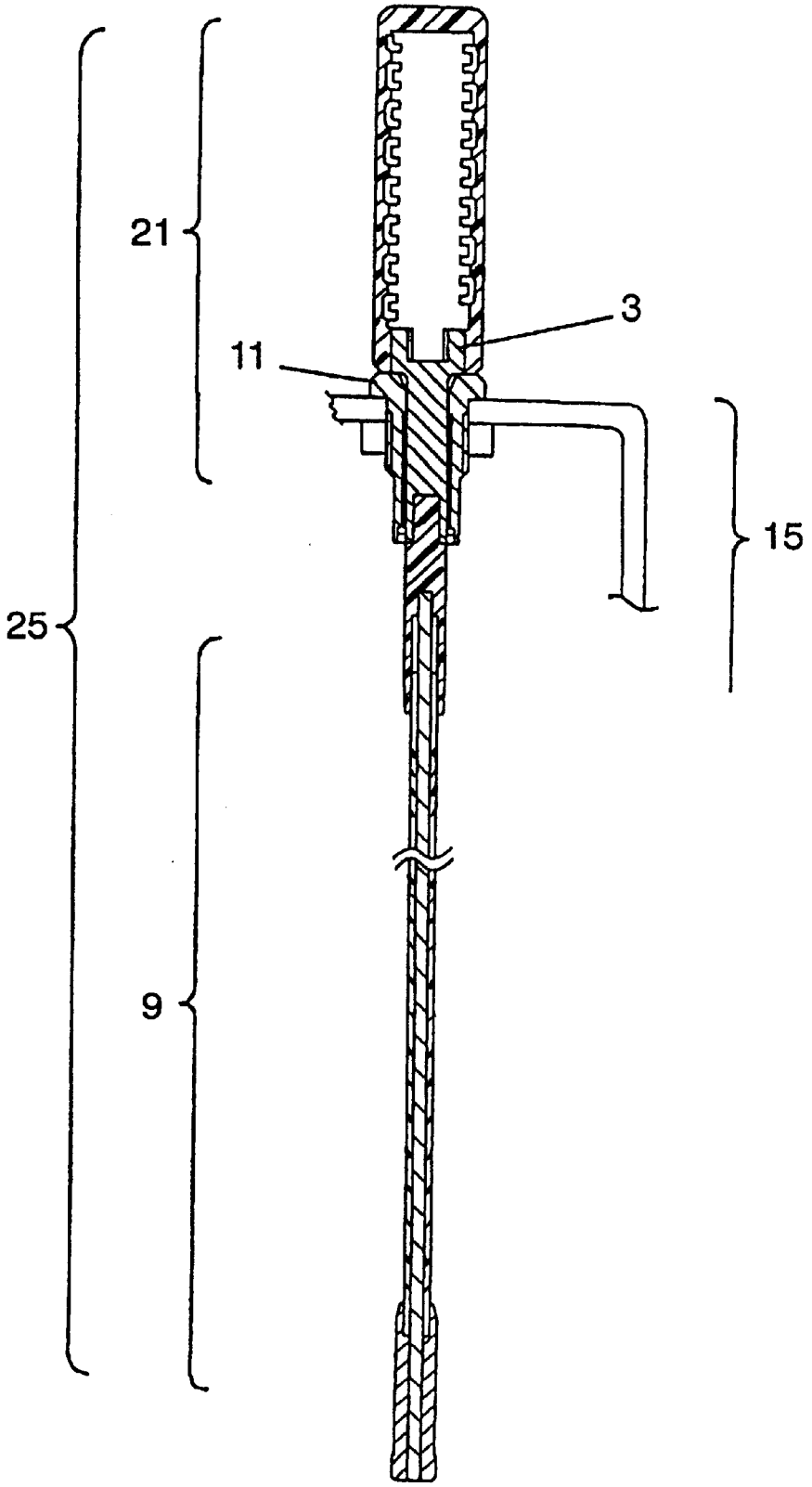
FIG. 5 is a cross-sectional view of the top-helical type antenna of the first embodiment of the present invention with the antenna stored within an enclosure of wireless transmission equipment.

Transmitting and receiving radio waves by the top-helical type antenna 25 of the above structure is carried out as described below. When the top-helical type antenna 25 is extended as shown in FIG. 3, radio waves are transmitted and received by the whip antenna 9 that is electrically connected through the stopper 8 in contact with the antenna holder 11 fitted to the wireless transmission equipment 15. Alternatively, when the whip antenna 9 is retracted within the wireless transmission equipment 15 as shown in FIG. 5, the radio waves are transmitted and received by the helical antenna 21 that is electrically connected through the feeding fixture 3 in contact with the antenna holder 11. The operation here is same as that of the prior art.

As has been described, the present embodiment forms the helical coil members 22C consecutively on a belt-shaped strip of the electrically conductive metallic sheet 26 by die cutting and press work. These helical coil members are then sheared off at the linkage portions 26A from the conductive metallic sheet 26 after being outsert-injection molded with an electrically nonconductive material, such as an insulating resin, to form the bobbin 23. The helical antenna element 22 and the bobbin 23 are thus integrated into one piece. This helical antenna element 22 is then enclosed by a cover 24 constructed of an electrically nonconductive material such as an insulating resin around the outer periphery to form the helical antenna 21. Accordingly, the invention provides a helical antenna element 22 that is easy to produce but difficult to deform, has a stable impedance-to-frequency characteristic, and is easy to handle when assembling into an antenna.

Figure 6:
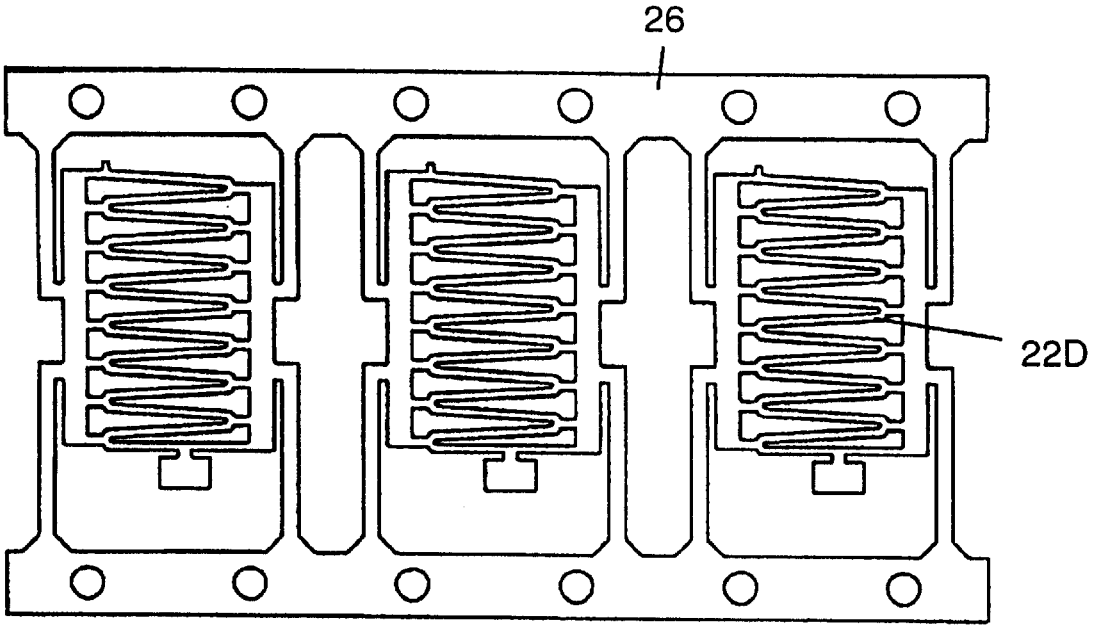
FIG. 6 is a plan view of the helical coil member of another embodiment of the present invention.
Figure 7:
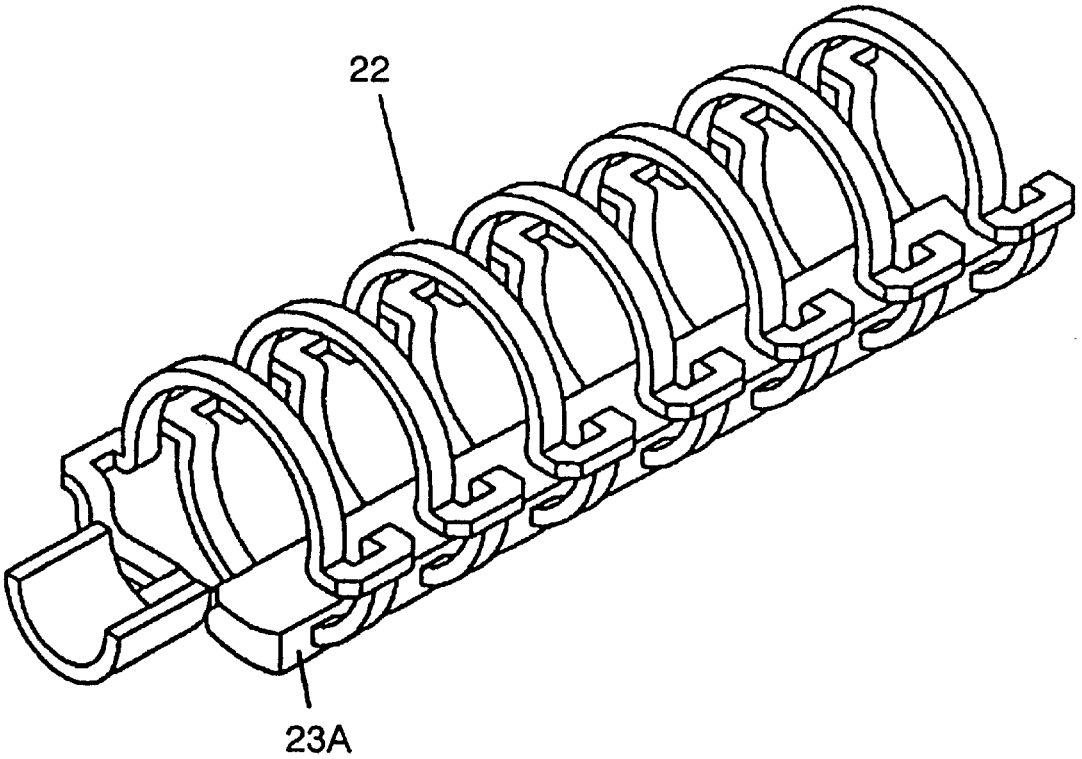
FIG. 7 is a perspective view of a helical antenna element of another embodiment of the present invention.

In the above embodiment, although the shape of die-cutting the helical coil member 22B on the belt-shaped strip of electrically conductive metallic sheet 26 has been described as to be substantially U-shaped as shown in FIG. 4A, it may be die-cut in substantially V-shaped form as shown by the helical coil member 22D in FIG. 6. The substantially V-shaped branch portions are connected continuously in a manner to place their open ends alternately inversely. Similar to the embodiment illustrated in FIG. 4C, the bobbin 23 is molded to cover the outer periphery of the helical coil member 22C except for a part, and a space inside the coil member 22C is filled with the insulating resin. However, the same effect is attained and the weight is lightened by molding a bobbin 23A for joining only part of the turns in the coil portion of the helical antenna elements 22 so as not to permit the resin to flow into other parts, as shown in FIG. 7.

Furthermore, a cross-section of each turn in the coil portion of the helical antenna element 22 need not be flat. If the element 22 is pressed in a manner to make the cross-section convex toward the outside as shown in FIG. 3, for example, rigidity of the coil is increased so as to increase a resistance against deformation.

Second Embodiment

Figure 8:
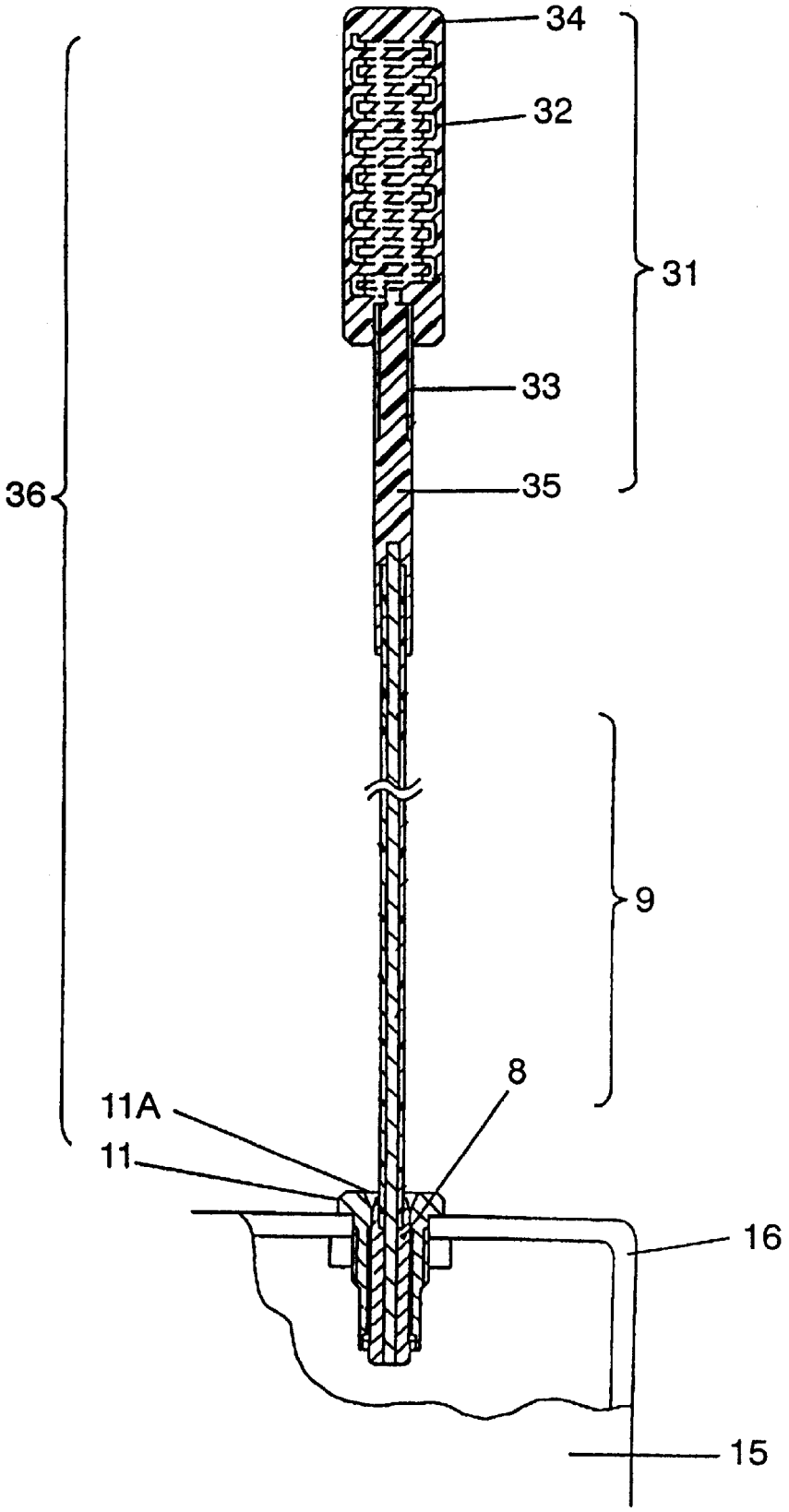
FIG. 8 is a cross-sectional view of the top-helical type antenna of a second embodiment of the present invention.

FIG. 8 is a cross-sectional view of a top-helical type antenna using a helical antenna of a second embodiment of the present invention. In the figure, the helical antenna 31 differs from that of the first embodiment in that it is provided with a conductive feeding part 33 at a lower end of the helical antenna element 32, whereas the other points remain unchanged such that a lower end of the helical antenna 31 is attached to an upper end of the whip antenna 9 via an insulator. The whip antenna 9 is inserted into a through hole 11A of the antenna holder 11 fitted within the enclosure 16 of the wireless transmission equipment 15, and the helical antenna element 32 is made of an electrically conductive metallic sheet.

The conductive feeding part 33 is provided with the helical antenna 32 in one body projecting in an axial direction from one end of a cover 34 of an insulating resin that is insert-injection molded for enclosing the helical antenna element 32. An insulating part 35 of the insulating resin is formed in a coupling portion between the helical antenna 31 and the whip antenna 9.

Figure 9A:
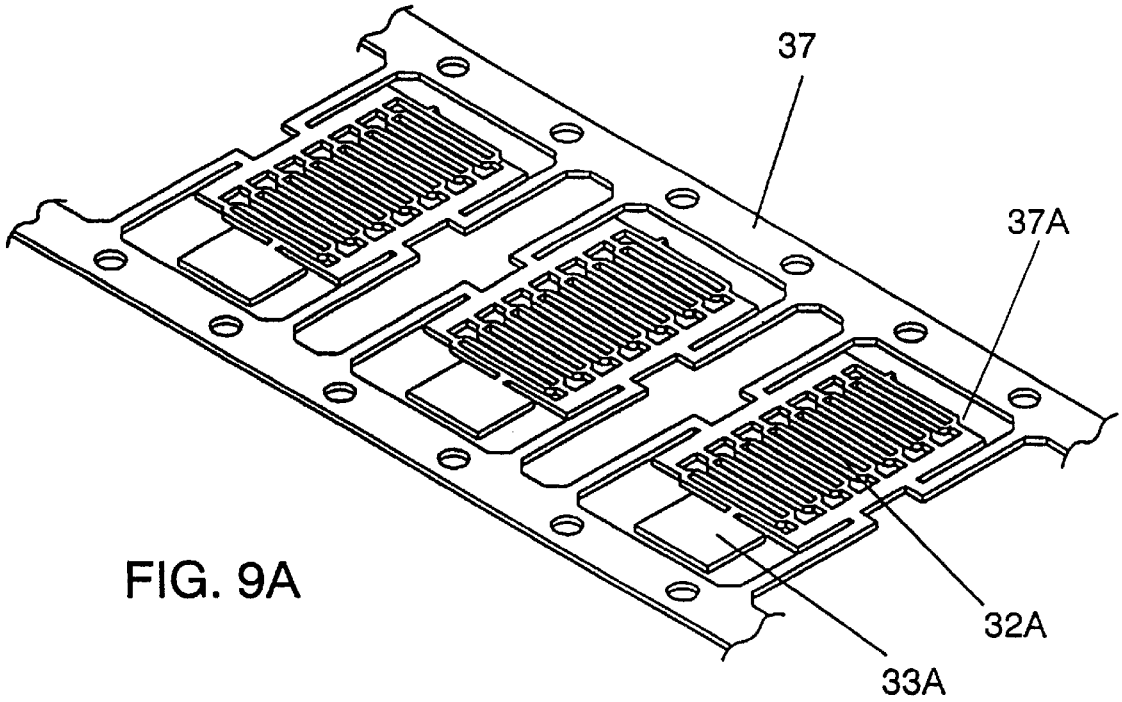
FIGS. 9A through 9D are perspective views depicting another method of producing the helical antenna of the present invention.
Figure 9B:
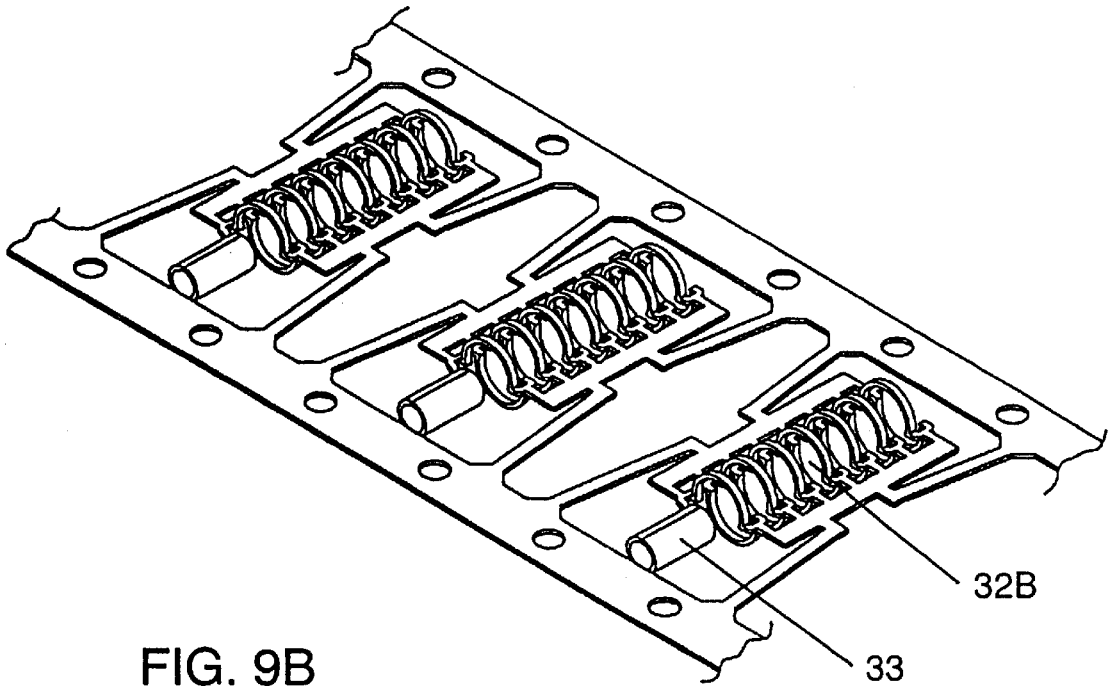
Figure 9C:
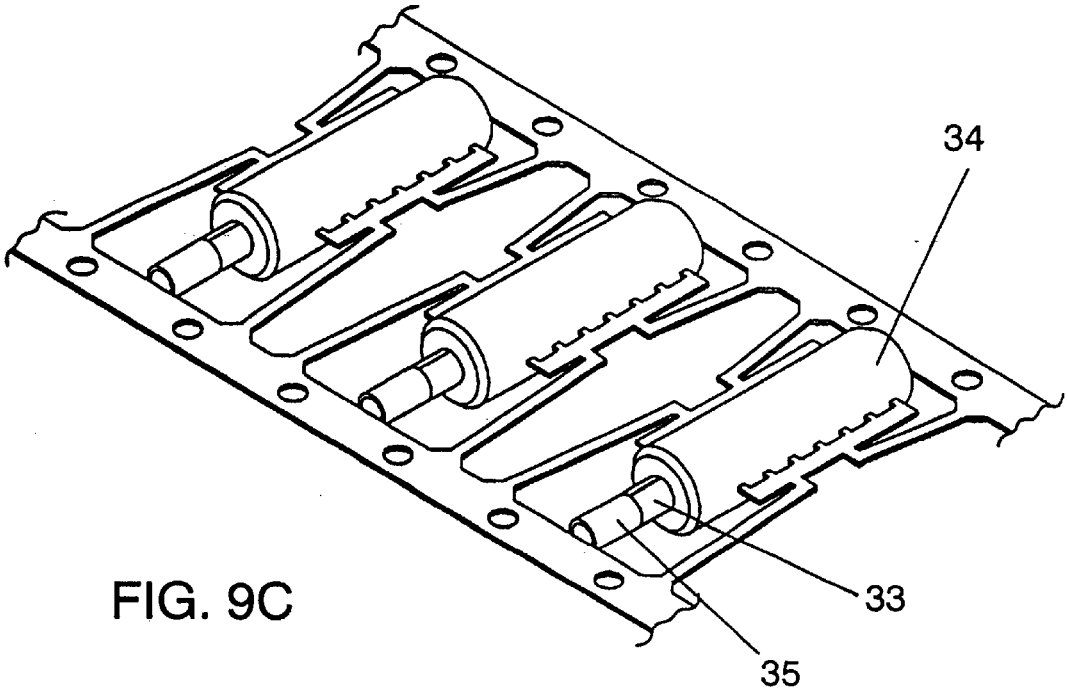
Figure 9D:
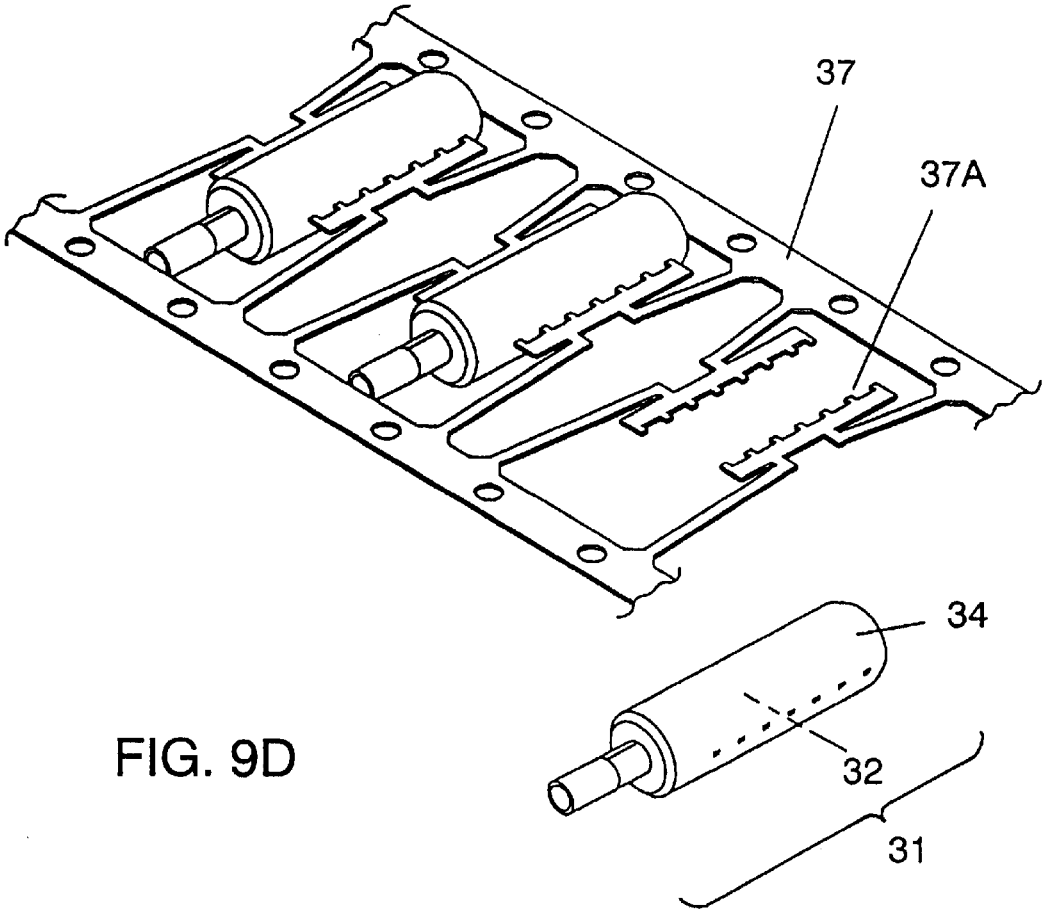

A method of producing the helical antenna 31 in the top-helical type antenna 36 in accordance with this embodiment is described below. First, helical coil member 32A and conductive feeding part member 33A are in a flat form and die-cut, wherein the helical coil member 32A is shaped so that a plurality of substantially U-shaped branch portions and nearly substantially U-shaped branch portions are lined alternately. The substantially U-shaped branch portions and the substantially inverse U-shaped branch portions are connected to form W-shaped letters with connection to a belt-shaped strip of electrically conductive metallic sheet 37 being held only by linkage portions 37A at opposing sides, as shown in FIG. 9A. The substantially U-shaped branch portions are connected continuously in a manner to place their open ends alternately inversely. Next, the U-shaped branch portions are pressed to configure helical coil member 32B in a coil form by curving the branch portions of the coil member in a nearly circularly-shaped arc toward an obverse side and a reverse side of the metallic sheet alternatively and conductive feeding part 33 in a cylindrical shape. An insulating resin is then outsert-injection molded to form a cover 34 for enclosing the helical coil member 32B and the insulating part 35 for connection to the conductive feeding part 33 as shown in FIG. 9C. And finally, the helical antenna 31 comprising the helical antenna element 32 enclosed by the cover 34 is completed after shearing off the linkage portions 37A from the electrically conductive metallic sheet 37 as shown in FIG. 9D. If the molding is done in a manner to make an inside of the helical antenna element 32 hollow, that is, to allow the molding material to flow in between turns of the coil, the material is saved and the weight is reduced while maintaining a strong integrity between the turns of the coil.

Figure 10:
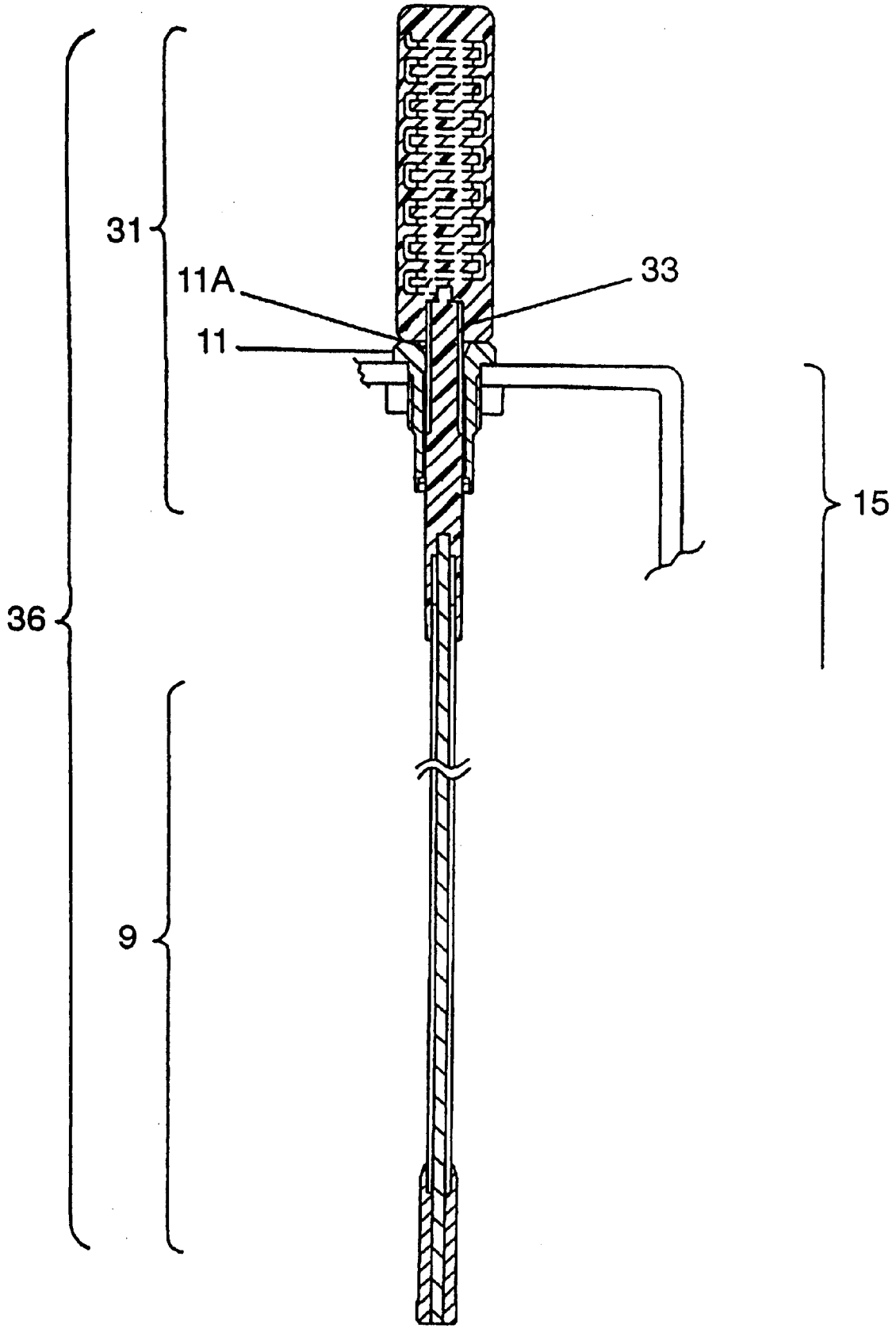
FIG. 10 is a cross-sectional view of the top-helical type antenna of the present invention with the antenna stored within the enclosure of wireless transmission equipment.

Transmitting and receiving radio waves by the top-helical type antenna 36 of the above structure is carried out as described below. In the same manner as in the first embodiment, radio waves are transmitted and received by the whip antenna 9 that is electrically connected through the stopper 8 in contact with the antenna holder 11 fitted to the wireless transmission equipment 15, when the antenna 36 is stretched as shown in FIG. 8. However, when the whip antenna 9 is retracted within the wireless transmission equipment 15 as shown in FIG. 10, the radio waves are transmitted and received by the helical antenna 31 that is electrically connected through the conductive feeding part 33 contacting directly with an inner periphery of the through hole 11A of the antenna holder 11.

As has been previously described, the present embodiment forms the cover 34 and the insulating part 35 at the same time by outsert-injection molding an electrically non-conductive material such as an insulating resin after the helical antenna element 32 and the conductive feeding part 33 are formed by die cutting and press work on the belt-shaped strip of electrically conductive metallic sheet 37. Also, the cover 34 connects portions between turns of the coil when the cover encloses the outer periphery of the helical coil member 32B. For this reason, the helical antenna 31 formed with the cover 34 and the insulating part 35 can be produced consecutively when producing the helical antenna elements 32, so there is formed a helical antenna element 32 that is not likely to deform, has a stable impedance-to-frequency characteristic and is easy to assemble, in addition to reducing the costs of construction.

According to this embodiment, when the whip antenna 9 is retracted within the wireless transmission equipment 15, an electrical connection to the antenna holder 11 is made by the conductive feeding part 33 that is provided at a lower end of the helical antenna element 32 as an integral part and projects in an axial direction from one end of the cover 34. As a result, a part such as the feeding fixture for electrically connecting the antenna holder 11 is omitted, thereby providing a top-helical type antenna that is easier to assemble and less expensive than similar prior art antennas.

Figure 11A:
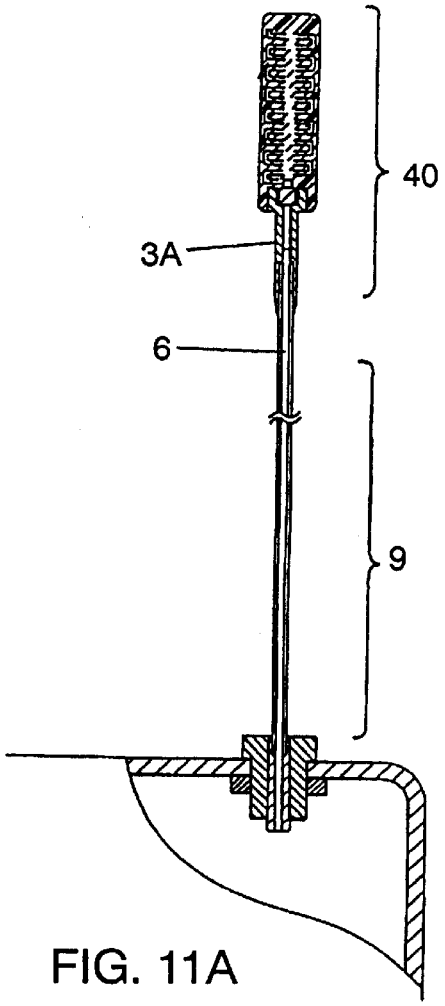
FIGS. 11A through 11D are cross-sectional views of another embodiment of the top-helical type antenna of another embodiment of the present invention.
Figure 11C:
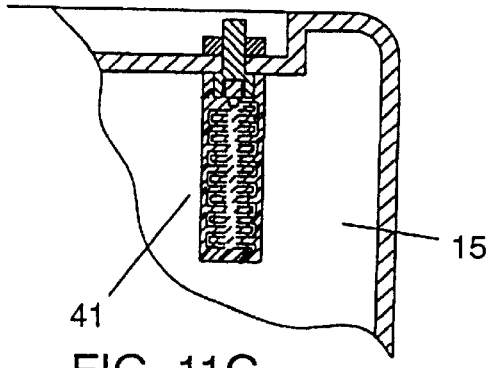
Figure 11B:
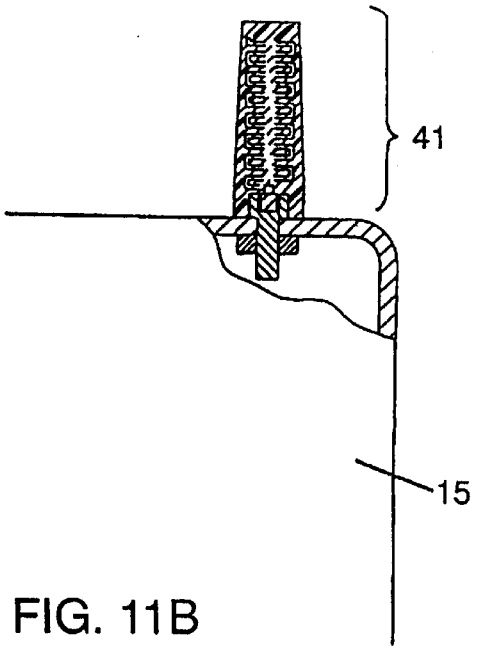
Figure 11D:
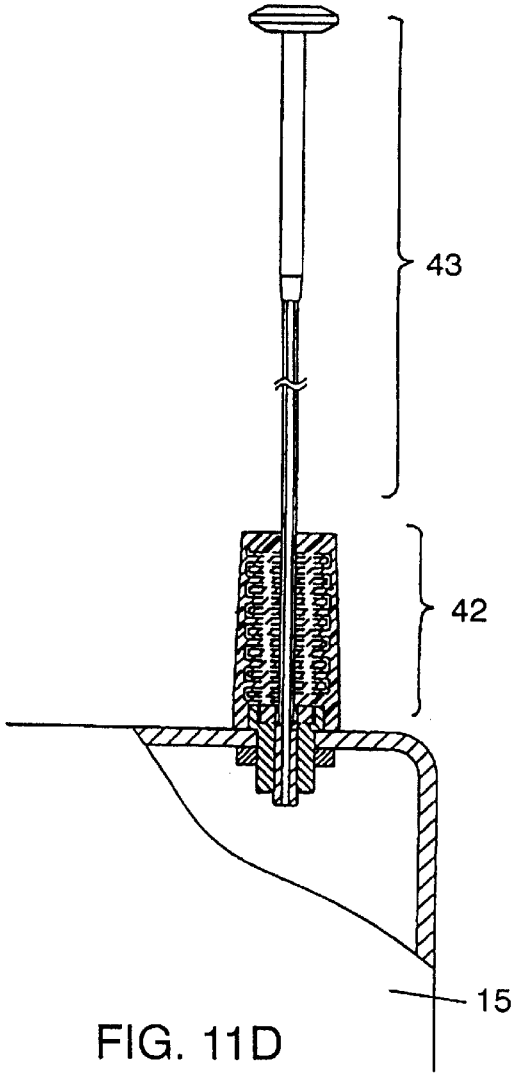

The present invention is not limited to the above embodiments. As has been previously described, a top-helical type antenna of this type, in which an upper end of the whip antenna 9 is joined to a lower end of the helical antenna 21 or 31 with insulation between them, can be formed. But this configuration is not exclusive and the present invention may be embodied in an antenna in which a conductor 6 of the whip antenna 9 is electrically connected with a feeding fixture 3A of the helical antenna 40 as shown in FIG. 11A. Similarly, as a matter of course, the present invention may also be practiced in a fixed helical type antenna where only a helical antenna 41 is mounted on the outside or the inside of the wireless transmission equipment 15 as shown in FIG. 11B and FIG. 11C, or in antennas such as a bottom-helical type antenna wherein a helical antenna 42 is fixed and a whip antenna 43 is retractable within the wireless transmission equipment 15 as shown in FIG. 11D. Additionally, other various modifications are possible such as using shapes other than U- or V-shaped branch portions that are within the spirit of the invention and the scope of the claims described hereinafter.

What is claimed is:

1. A helical coil comprising:

a plurality of branch portions made of a thin metallic sheet, the branch portions having one of a substantially U-shape and a substantially V-shape; wherein the branch portions are connected continuously so that their open ends alternate inversely;

the branch portions alternatively curve toward an obverse side and a reverse side of the metallic sheet to form each turn of said helical coil, the alternatively curved branch portions defining half-cylindrical portions of said helical coil, whereby said helical coil has a generally cylindrical configuration;

said helical coil has a center axis; and said helical coil includes a conductive feeding part extending from an end of said helical coil coaxial with said center axis.

2. The helical coil according to claim 1, further comprising a bobbin made of an electrically nonconductive material in a mold for connecting each turn of said helical coil.

3. The helical coil according to claim 2, wherein said each turn of the coil is formed with its cross-section being a shape other than flat.

4. The helical coil according to claim 2, wherein an insulating part is provided with said bobbin and projects in an axial direction of the helical coil with said conductive feeding part being exposed on an outer surface.

5. The helical coil according to claim 1, wherein an outer periphery of the helical coil is enclosed by a cover made of an electrically nonconductive material formed into a mold and connecting said each turn of said helical coil.

6. The helical coil according to claim 5, wherein said each turn of the coil is formed with its cross-section being a shape other than flat.

7. The helical coil according to claim 5, wherein an insulating part is provided with said cover and extends in an axial direction of the helical coil with said conductive feeding part being exposed on an outer surface.

8. The helical coil according to claim 1, wherein said each turn of the coil is formed with its cross-section being a shape other than flat.

9. A method of producing a helical coil, comprising:

continuously die-cutting a member on a belt-shaped strip of electrically conductive metallic sheet, wherein said member comprises one of a plurality of substantially U-shaped and a plurality of substantially V-shaped branch portions; positioning open ends alternating inversely, and the branch portions being connected with each other in a W-shape;

wherein connection to said electrically conductive metallic sheet is held only by a pair of linkage portions at opposite sides;

forming a helical coil by curving the branch portions into turns of helical coil of said one of a plurality of substantially U-shaped and a plurality of substantially V-shaped members in a substantially circular arc toward an obverse side and a reverse side of the metallic sheet alternatively;

forming a bobbin for connecting each turn of the turns of said helical coil by one of insert-injection molding and outsert-injection molding of an electrically nonconductive material on each individual turn of said helical coil formed of said belt-shaped strip of electrically conductive metallic sheet; and shearing off the linkage portions to the electrically conductive metallic sheet.

10. The method of producing a helical coil according to claim 9, wherein the die-cutting also comprises forming into said helical coil a conductive feeding part coaxial with a center axis of said helical coil; and the method further includes forming a bobbin in an insulating part projecting in an axial direction of said helical coil with said conductive feeding part being exposed on an outer surface.

11. A method of producing a helical coil, comprising:

continuously die-cutting a member on a belt-shaped strip of electrically conductive metallic sheet, wherein said member comprises one of a plurality of substantially U-shaped and a plurality of substantially V-shaped branch portions;

positioning open ends alternating inversely, the branch portions being connected with each other in a W-shape wherein connection to said electrically conductive metallic sheet is held only by a pair of linkage portions at opposite sides;

forming a helical coil by curving the branch portions into turns of helical coil of said one of a plurality of substantially U-shaped and a plurality of substantially V-shaped members in a substantially circular arc toward an obverse side and a reverse side of the metallic sheet alternatively;

forming a cover for connecting each turn of the turns of helical coil and for enclosing an outer periphery thereof by one of insert-injection molding and outsert-injection molding of electrically nonconductive material on each individual turn of said helical coil formed of said belt-shaped strip of electrically conductive metallic sheet; and shearing off the linkage portions to the electrically conductive metallic sheet.

12. The method of producing a helical coil according to claim 11, wherein said die-cutting comprises forming into said helical coil a conductive feeding part coaxial with a center axis of said helical coil, and forming a cover also comprises forming an insulating part extending in an axial direction of said helical coil with said feeding part being exposed on an outer surface.

13. A helical antenna having a helical coil, said antenna comprising a plurality of branch portions made of a thin metallic sheet and having one of a substantially U-shape and a substantially V-shape, the branch portions being connected continuously so that their open ends alternate inversely; wherein the branch portions alternatively curve toward an obverse side and a reverse side of the metallic sheet to form each turn of said helical coil, the alternatively curved branch portions defining half-cylindrical portions of said helical coil, whereby said helical coil has a generally cylindrical configuration;

said helical coil having a center axis; and said helical coil including a conductive feeding part extending from an end of said helical coil coaxial with said center axis.

14. The helical antenna according to claim 13, wherein said helical coil is formed into a single body with a bobbin made of an electrically nonconductive material for connecting to each turn of said helical coil.

15. The helical antenna according to claim 14, wherein said helical coil forms into a single piece with said conductive feeding part and an insulating part is provided into a mold with said bobbin projecting in an axial direction of said helical coil with the feeding part being exposed on a surface of a portion of said insulating part.

16. The helical antenna according to claim 13, wherein an outer periphery of said helical coil is enclosed by a cover made of an electrically nonconductive material formed into one body and connecting to each turn of said helical coil.

17. The helical antenna according to claim 16, wherein said helical coil forms into a single piece with said conductive feeding part coaxial with a center axis of said helical coil, and an insulating part is provided into a mold with said cover and extending in an axial direction of said helical coil with the feeding part being exposed on a surface of a portion of said insulating part.

18. A method of producing an antenna, comprising:

continuously die-cutting a member on a belt-shaped strip of electrically conductive metallic sheet, wherein said member comprises one of a plurality of substantially U-shaped and a plurality of substantially V-shaped branch portions; positioning open ends alternating inversely, and the branch portions being connected with each other in a W-shape;

wherein connection to said electrically conductive metallic sheet is held only by a pair of linkage portions at opposite sides;

forming a helical coil by curving the branch portions into turns of helical coil of said one of a plurality of substantially U-shaped and a plurality of substantially V-shaped members in a substantially circular arc toward an obverse side and a reverse side of the metallic sheet alternatively;

forming a bobbin for connecting each turn of the turns of said helical coil by one of insert-injection molding and outsert-injection molding of an electrically nonconductive material on each individual turn of said helical coil formed of said belt-shaped strip of electrically conductive metallic sheet; and shearing off the linkage portions to the electrically conductive metallic sheet.

19. A method of producing an antenna, comprising:

continuously die-cutting a member on a belt-shaped strip of electrically conductive metallic sheet, wherein said member comprises one of a plurality of substantially U-shaped and a plurality of substantially V-shaped branch portions;

positioning open ends alternating inversely, the branch portions being connected with each other in a W-shape wherein connection to said electrically conductive metallic sheet is held only by a pair of linkage portions at opposite sides;

forming a helical coil by curving the branch portions into turns of helical coil of said one of a plurality of substantially U-shaped and a plurality of substantially V-shaped members in a substantially circular arc toward an obverse side and a reverse side of the metallic sheet alternatively;

forming a cover for connecting each turn of the turns of helical coil and for enclosing an outer periphery thereof by one of insert-injection molding and outsert-injection molding of electrically nonconductive material on each individual turn of said helical coil formed of said belt-shaped strip of electrically conductive metallic sheet; and shearing off the linkage portions to the electrically conductive metallic sheet.

20. A method of producing an antenna, comprising:

continuously die-cutting a member on a belt-shaped strip of electrically conductive metallic sheet, wherein said member comprises one of a plurality of substantially U-shaped and a plurality of substantially V-shaped branch portions; positioning open ends alternately inversely, and the branch portions being connected with each other in a W-shape;

wherein connection to said electrically conductive metallic sheet is held only by a pair of linkage portions at opposite sides;

forming a helical coil by curving the branch portions into turns of helical coil of said one of a plurality of substantially U-shaped and a plurality of substantially V-shaped members in a substantially circular arc toward an obverse side and a reverse side of the metallic sheet alternatively;

forming into said helical coil during die-cutting of the member a conductive feeding part coaxial with a center axis of said helical coil;

forming a bobbin for connecting each turn of the turns of said helical coil by one of insert-injection molding and outsert-injection molding of an electrically nonconductive material on each individual turn of said helical coil formed of said belt-shaped strip of electrically conductive metallic sheet, said bobbin being formed in an insulating part projecting in an axial direction of said helical coil with said conductive feeding part being exposed on an outer surface; and shearing off the linkage portions to the electrically conductive metallic sheet.

21. A method of producing an antenna, comprising:

continuously die-cutting a member on a belt-shaped strip of electrically conductive metallic sheet, wherein said member comprises one of a plurality of substantially U-shaped and a plurality of substantially V-shaped branch portions;

positioning open ends alternately inversely, the branch portions being connected with each other in a W-shape wherein connection to said electrically conductive metallic sheet is held only by a pair of linkage portions at opposite sides;

forming a helical coil by curving the branch portions into turns of helical coil of said one of a plurality of substantially U-shaped and a plurality of substantially V-shaped members in a substantially circular arc toward an obverse side and a reverse side of the metallic sheet alternatively;

forming into said helical coil during die-cutting of the member a conductive feeding part coaxial with a center axis of said helical coil;

forming a cover for connecting each turn of the turns of helical coil and for enclosing an outer periphery thereof by one of insert-injection molding and outsert-injection molding of electrically nonconductive material on each individual turn of said helical coil formed of said belt-shaped strip of electrically conductive metallic sheet to define an insulating part extending in an axial direction of said helical coil with said feeding part being exposed on an outer surface; and shearing off the linkage portions to the electrically conductive metallic sheet.

* * * * *